United States Patent [19]

Mack

[11] 4,089,513

[45] May 16, 1978

[54] HOLDING CLAMP MEANS FOR LOCKING PLIERS

[76] Inventor: Raymond F. Mack, R.R. 7 - Box 20, Greenfield, Ind. 46140

[21] Appl. No.: 767,532

[22] Filed: Feb. 10, 1977

[51] Int. Cl.[2] ..... B25B 5/16

[52] U.S. Cl. ..... 269/96; 269/97

[58] Field of Search ..... 269/96, 88, 97, 71, 269/249

[56] References Cited

U.S. PATENT DOCUMENTS

| | | | |
|---|---|---|---|
| 1,821,163 | 9/1931 | King | 269/249 |
| 2,756,789 | 7/1956 | Kraus et al. | 269/97 |
| 3,718,327 | 2/1973 | Nunez | 269/96 |
| 3,907,269 | 9/1975 | Baker | 269/96 |

*Primary Examiner*—Robert C. Watson
*Attorney, Agent, or Firm*—Robert A. Spray

[57] ABSTRACT

A holding clamp means provides a 3-point tight although releasable clamping of a pair of locking pliers, the clamping involving a torque-imposing and a torque-resisting effect achieving particularly snug and sturdy tightness even though easily releasable, and the clamp means itself is mounted on an adjustable stand or support; and thus the clamp means optionally and releasably serves economically as a bench-mounted clamp or vise.

6 Claims, 3 Drawing Figures

HOLDING CLAMP MEANS FOR LOCKING PLIERS

The present invention relates to a conversion means, by which a pair of locking pliers are securely although releasably held and supported in a manner such that they may serve as a bench-mounted clamp or vise.

More particularly, in the illustrative embodiment, the invention achieves a mounting means for locking pliers which provides a tight 3-point clamping of the pliers, by two bearing means carried on an L-shaped body member or bracket piece, these being respectively bearingly engageable with one of the opposed side faces of one of the walls of one of the handle members of the locking pliers, and by a movable bearing means, here in the form of a screw member, which is movably supported by the bracket member between a non-clamping position and a clamping position in which it bears tightly, in a torque-producing manner, against said handle member of the said locking pliers.

The invention also achieves an economy of construction by the economy of an L-shaped clamp body, with one leg thereof integrally turned over or formed to provide one of the bearing points, and with a formed groove therebetween into which is placed the pliers handle member wall to which the clamp is to be affixed.

Further, the concepts achieve a secure tightness, even though of quickly and easily releasable nature, by concepts which provide that the bearing engagement of the movable screw member exerts a tight clamping by imposing a rotational torque upon the pliers handle member, this torque being opposed by the reaction torque-imposed by the bearing of the two other of the bearing supports carried by the bracket body, one of those said other bearing supports serving as a fulcrum with respect to the other of the two bearing supports and the bearing of the movable clamping member which imposes the torque, the three-point support providing a secure and tight clamping of the associated locking pliers handle; and it is this rotational torque effect, and its opposition by the two bearing means, which achieves the particularly tight and snug clamping even though it is easily releasable when desired.

The concepts further provide economy by the provision of the clamp bracket in the form of a unitary piece of sheet or other metal which is formed to provide the two fixed bearing supports and also the support for the said movable screw or other movable clamping member which is utilized to provide the torque-imposing third of the tight although releasable 3-point support of the locking pliers, by which they are effectively useful as a bench-mounted clamp or vise.

The above description is of an introductory and generalized nature, particularly to mention the general objects and achievements and desirability of the present invention, as providing economically a bench-mounted clamp or vise from a pair of locking pliers.

More particular and specific concepts, features, and details are set forth in the following more detailed description of an embodiment illustrative of the invention's concepts, taken in conjunction with the accompanying drawings.

In those drawings, which are somewhat schematic and diagrammatic in nature, it will be noted as follows.

Figure 1:
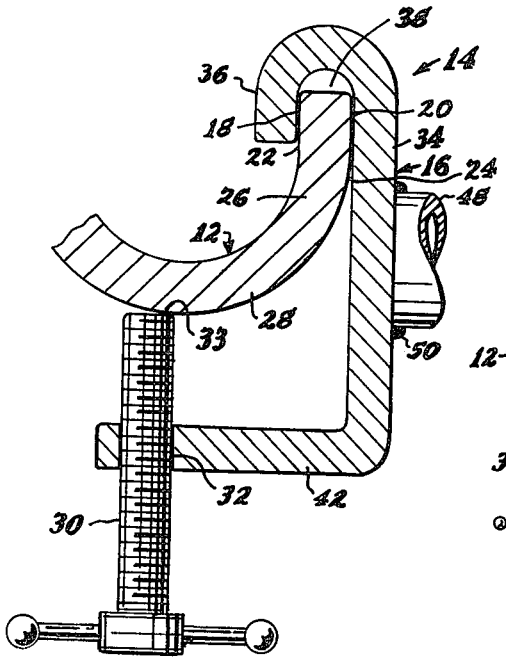
FIG. 1 is a vertical cross-sectional view through the clamp of an illustrative embodiment of the invention, illustrating its use with an associated pair of locking pliers and with the clamp-screw in clamping position causing the 3-point or torque-imposing leverage type tight clamping hereby achieved.
Figure 2:
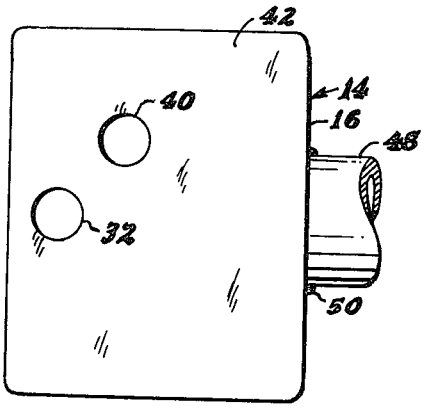
FIG. 2 is a bottom plan view of the clamp's body member.

As shown in the drawings, a preferred embodiment illustrative of the inventive concepts provides in effect a bench-mounted clamp or vise 10 from an associated pair of locking pliers 12.

A very tightly secure, although easily releasable, clamping of the locking pliers 12 is achieved by what might be referred to as a 3-point or torque-imposing clamping. This effect, as well as the details of the clamp 14 itself, are set forth in the following description.

In the form shown, the clamp 14 is shown as provided by an L-shaped body or bracket member 16; and that L-shaped member 16 is shown as provided with two bearing means 18 and 20, which are shown as integrally formed from the member 16, and which are respectively bearingly engageable with one of the opposed side faces 22 and 24 of one of the walls 26 of one of the handle members 28 of the associated locking pliers 12.

Further, it will be noted that the clamp means 14 is also provided with a movable clamp member here shown as a screw 30, and with support means here shown as a threaded opening 32 which movably supports the movable screw means 30 in and between a non-clamping position and a clamping position in which it bears (at 33) against the handle member 28 of the locking pliers 12.

Thus it is seen that the arrangement is such that at least a triple or 3-point support bearing engagement of the pliers handle member 28 is achieved; that is, the 3-point support is achieved respectively by the two bearingly engageable means 18 and 20 of the clamp body bracket 16 bearing against the side faces 22 and 24 of the pliers handle member wall 26, and the third support is achieved by the movable means (here screw 30) bearing against the pliers handle member 28.

More particularly, it will be noted that the first two (18 and 20) of the three bearing engagements, in the illustrative form here shown, are provided respectively by the top portion of the upright leg 34 of the body member 16 of the clamp means 14 and by a turned-over member 36 rigidly interconnected to that upright leg 34 of the clamp means body member 16. That turned-over member 36 is shown as economically provided as an integral extension of the leg 34 of the L-shaped bracket body 16 of the clamp 14.

Further with respect to the bearing points 18 and 20 of clamp body leg 34 and turned-over member 36, it is noted that the leg 34 and its rigidly interconnected extension 36 are formed to provide a groove 38 therebetween; and into that groove 38 is placed the handle member wall 36 of the pliers 12.

And further with respect to the 3-point clamping, its particularly tight although releasable effect is achieved by a sort of torque-imposing or leverage effect. That is, the bearing engagement of the movable clamp-screw 30 exerts a rotational torque upon the handle member 28 (having reference to the location of bearing engagement against the handle member 28 by one of the first two bearing supports 18, 20), which torque is opposed by the bearing of the other of the said bearing supports 18, 20; and thus whichever of the bearing supports 18 - 20 is considered a fulcrum and the other a reaction support, the three-point torque-imposing support provides a very secure and tight clamping of the associated locking pliers handle 28 by that tight leverage thereby achieved.

The clamping here achieved provides the further advantage that it does not interfere with the function or operation of the pliers 12.

Additional advantage is shown as obtained by the provision of a second screw-threaded opening 40 provided in the horizontal leg 42 of the L-shaped bracket body 16, at a distance from body member's upright leg 34 other than is the first-designated screw threaded opening 32; and this provides that the two openings 32 and 40 are optionally selectable to obtain a location of the screw threaded movable means 30 which causes its bearing engagement 33 with the pliers handle 28 to be at whichever location is better, depending upon the size and shape of the pliers handle 28.

Further economy is achieved by the provision of the clamp 14 fully being provided (except for screw 30, itself a standard or non-custom item) from a unitary piece of metal formed to provide the two legs 34 and 42 and two bearing supports 18 and 20 and the support (here leg 42) for the movable third-point clamp means 30.

Figure 3:
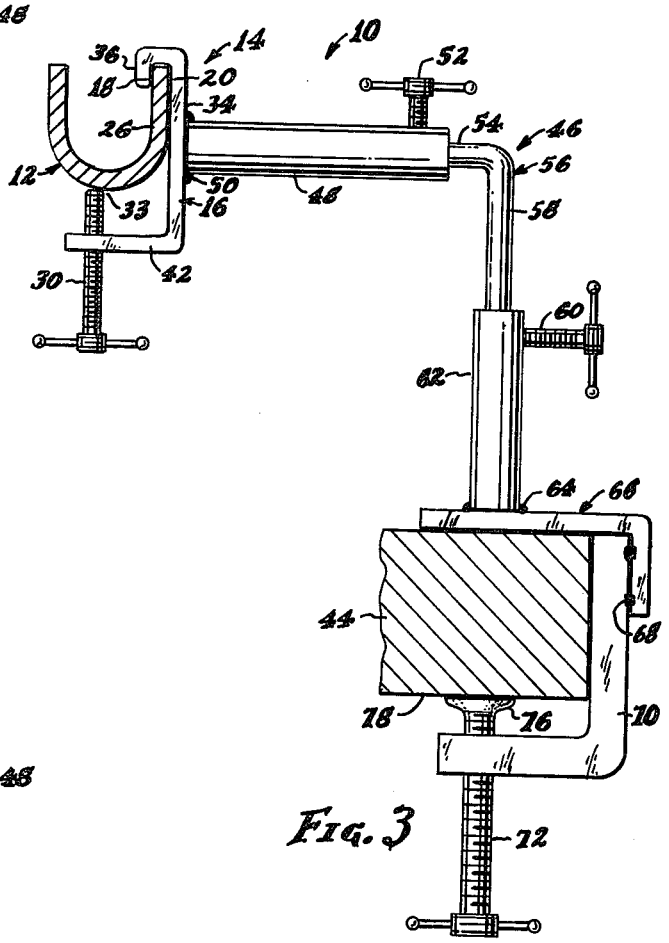
FIG. 3 is an assembly pictorial illustration of the clamp means of the locking pliers, but on reduced scale from FIGS. 1 and 2, and illustrating the clamp means in conjunction with its supporting members by which the clamp supports the associated locking pliers on a workbench, achieving in effect a bench-mounted clamp or vise.

FIG. 3 illustrates the support of the clamp 14 and its body bracket 16 from an associated work-bench, diagrammatically illustrated at 44, providing in effect a bench-mounted clamp or vise from the pair of locking pliers 12.

As illustratively shown in FIG. 3, the clamp's body bracket 16 is supported by an adjustable support standard 46. In the form shown, the bench-mounted standard or support 46 comprises a support sleeve 48 shown welded as at 50 to the upright leg 34 of the clamp's bracket piece 16.

That support sleeve 48 carries a clamp-screw 52 which tightly grips the horizontal portion 54 of a support angle 56 whose vertical leg 58 is in turn supported by being clamped by a clamp-screw 60 of a vertical support sleeve 62 shown welded at 64 to an upper bracket 66 which overlies the work-bench 44. That upper bracket 66 is shown welded at 68 to a lower bracket 70 which carries a clamp-screw 72 whose foot 76 engages the under side 78 of the work bench 44.

SUMMARY

It is seen that a conversion unit provided by the holding clamp means is novel and advantageous; for, by the inventive concepts here illustrated, a novel and advantageous mounting and clamping is achieved for locking pliers.

Accordingly, it will thus be seen from the foregoing description of the invention according to this illustrative embodiment, considered with the accompanying drawings, that the present invention provides a novel device which achieves the desirable goal of achieving a conversion unit for locking pliers, by which they provide in effect a bench-mounted vise.

Thus there is achieved desired advantages and characteristics, and the accomplishment of the inventor's intended objects, including those hereinbefore pointed out and others which are inherent in the invention.

These advantages and characteristics include a secure and tight clamping, by providing and achieving a torque-imposing and a torque-resisting clamping nature or effect, yet a clamping which is quickly releasable so as to permit the locking pliers to be used optionally in their customary manner, as desired, yet again quickly converted to their bench-mounted vise use here explained.

Modifications and variations may be effected without departing from the scope of the novel concepts of the invention; accordingly, the invention is not limited to the specified form or arrangement of parts herein described or shown for illustration of the inventive concepts.

I claim:

1. A holding clamp means for releasably but securely holding an associated pair of locking pliers, thereby providing that they may serve as a bench-mounted clamp or vise, comprising:

the clamp means being provided with two bearing means respectively bearingly engageable with one of the opposed side faces of one of the walls of one of the handle members of the locking pliers;

a movable means;

the clamp means also being provided with means movably supporting the movable means in and between a non-clamping position and a clamping position in which it bears against said handle member of the said locking pliers;

the arrangement being such that at least a triple support bearing engagement of the said handle member is achieved, respectively by the aforesaid two bearingly engageable means of the clamp means bearing against the said handle member wall side faces, and the third by the said movable means bearing against the said handle member as aforesaid;

in which the clamp means is provided by a body member of a general L-shape, one leg of which provides or carries both of the said first two supports and the other leg of which provides or carries the movable support of the leg movable means;

and in which the said other body member leg is provided with a screw-threaded opening which screw-threadedly receives a screw threaded means which comprises the said movable means;

in a combination in which a second screw-threaded opening is provided in said other body member leg, at a distance from said first body member leg other than is the said first-designated screw threaded opening, thereby providing that the two said openings are optionally selectable to obtain a location of the said screw threaded movable means which causes its bearing engagement with the said pliers handle to be at whichever location is better depending upon the size and shape of the said pliers handle.

2. The invention as set forth in claim 1 in a combination in which the first two of the said bearing engagements are provided respectively by a body member of the clamp means and by a member rigidly interconnected to the said clamp means body member.

3. The invention as set forth in claim 2 in a combination in which the rigidly interconnected member is provided as an integral extension of the said clamp means body member.

4. The invention as set forth in claim 3 in a combination in which the said clamp means body member and its said rigidly interconnected member are formed to provide a groove therebetween into which is placed the said handle member wall.

5. The invention as set forth in claim 1 in a combination in which the clamp means is provided from a unitary piece of sheet metal formed to provide the said first two bearing supports and the support for the said movable means.

6. The invention as set forth in claim 1, in a combination in which the means, which movably supports the aforesaid movable means, supports the same in a manner and location with respect to the first-mentioned two bearing means such that the bearing engagement of the said movable means exerts a rotational torque upon the said handle member having reference to the location of bearing engagement against said handle member by one of the first two bearing supports, the other of said first two bearing supports serving as a fulcrum, which torque is opposed by the bearing of the said two bearing supports, one serving as a fulcrum and the other as a reaction support, and the three-point support with its torque-imposing and torque-sustaining nature thereby providing a secure and tight although releaseable clamping of the associated locking pliers handle.

* * * * *

UNITED STATES PATENT OFFICE

CERTIFICATE OF CORRECTION

Patent No. 4089513 Dated May 16, 1978

Inventor(s) Raymond F. Mack

It is certified that error appears in the above-identified patent and that said Letters Patent are hereby corrected as shown below:

Column 4, Line 42: The word "leg" should be "said"

Column 2, Line 67: Before "handle" insert "said"

Column 3, Line 53: Before "seen" insert "thus"

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*